US008087865B2

(12) United States Patent
Kaneko et al.

(10) Patent No.: US 8,087,865 B2
(45) Date of Patent: Jan. 3, 2012

(54) BOOKBINDING APPARATUS AND IMAGE FORMING SYSTEM PROVIDED THEREWITH

(75) Inventors: Masahiro Kaneko, Hino (JP); Tsuyoshi Tsuchiya, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 716 days.

(21) Appl. No.: 11/703,075

(22) Filed: Feb. 7, 2007

(65) Prior Publication Data

US 2008/0056791 A1 Mar. 6, 2008

(30) Foreign Application Priority Data

Aug. 30, 2006 (JP) ..... 2006-233318

(51) Int. Cl.
*B42C 9/00* (2006.01)
*G03G 15/00* (2006.01)
*B05C 11/02* (2006.01)

(52) U.S. Cl. ..... 412/37; 412/8; 412/900; 399/408; 118/103; 118/118

(58) Field of Classification Search ..... 412/1, 4, 412/8, 36, 37, 11, 12, 14, 900; 118/663, 118/664, 708, 103, 118, 123, 261, 413, 419; 270/58.08, 58.09; 399/408
See application file for complete search history.

(56) References Cited

U.S. PATENT DOCUMENTS 4,014,287 A * 3/1977 Green ..... 118/696
4,310,576 A * 1/1982 Hesselmann et al. ..... 427/207.1
4,925,355 A * 5/1990 Faber et al. ..... 412/37
5,605,575 A * 2/1997 Anderson ..... 118/679
5,693,142 A * 12/1997 Pedigrew et al. ..... 118/261
6,447,230 B1 * 9/2002 Takai et al. ..... 412/14
6,503,040 B1 * 1/2003 Abegglen et al. ..... 412/37
6,964,707 B2 * 11/2005 Taniguchi et al. ..... 118/244
7,448,837 B2 * 11/2008 Oota ..... 412/37
2003/0185654 A1 * 10/2003 Rathert ..... 412/37
2008/0054546 A1 * 3/2008 Kaneko et al. ..... 270/58.08

FOREIGN PATENT DOCUMENTS

JP S52-43519 8/1950
JP 2000-168265 6/2000
JP 2004-20987 7/2004
JP 2004-209744 7/2004

OTHER PUBLICATIONS

Japanese Office Action dated Sep. 16, 2008.

* cited by examiner

*Primary Examiner* — Dana Ross
*Assistant Examiner* — Kyle Grabowski
(74) *Attorney, Agent, or Firm* — Finnegan, Henderson, Farabow, Garrett & Dunner, L.L.P.

(57) ABSTRACT

In a bookbinding apparatus provided with a coating device having a coating roller to coat an adhesive onto a spine of a sheet bundle by moving relatively the coating roller and the spine in both forward and backward movement while making the coating roller and the sheet bundle to face each other, the coating device includes: a first regulating member provided downstream of the coating roller in the forward movement, which regulates a thickness of a layer of the adhesive coated on the spine of the sheet bundle; and a second regulating member provided downstream of the coating roller in the backward movement, which regulates a thickness of a layer of the adhesive coated on the spine of the sheet bundle.

8 Claims, 4 Drawing Sheets

BOOKBINDING APPARATUS AND IMAGE FORMING SYSTEM PROVIDED THEREWITH

This application is based on Japanese Patent Application No. 2006-233318 filed on Aug. 30, 2006, which is incorporated hereinto by reference.

BACKGROUND OF THE INVENTION

The present invention relates to a bookbinding apparatus and an image forming system, particularly to a bookbinding apparatus for producing a booklet by binding a plurality of sheets of paper with adhesive, and an image forming system provided with such a bookbinding apparatus.

In the field of shortrun-printing, there has been widespread use of an image forming system for producing a booklet in one process from printing to bookbinding by combination between an image forming apparatus of high-speed image forming performance such as an electrophotographic image forming apparatus, and a bookbinding apparatus.

In contrast to the conventional bookbinding process wherein printing and bookbinding are performed in separate processes, such an image forming system has the advantage of modifying what is to be printed whenever required, despite its lower printing speed and bookbinding speed. This system is an image forming system characterized by high efficiency when evaluated in a comprehensive manner, and is utilized as a POD (Print On Demand) system.

In the POD system, the image forming apparatus is linked with the bookbinding apparatus. Further, the POD system is often installed in an office or a building shared by an office, not in a workshop particularly built for printing and bookbinding. This requires the POD system and its constituent parts to be designed in a compact configuration.

Thus, the bookbinding apparatus employed in this field produces a booklet by bundling sheets in a comparatively simple process of gluing.

The Unexamined Japanese Patent Application Publication No. 2000-168265 discloses a compact bookbinding apparatus wherein a bundle of sheets is moved to a coating roller to cause relative movement of the coating roller across the length of the spine of a bundle of sheets, whereby an adhesive is coated to produce a booklet. In the Patent Application Publication, a scraping roller is provided to control the thickness of the adhesive layer formed on the spine of a bundle of sheets. The space between the scraping roller and the spine of the bundle of sheets is adjusted according to the thickness of the bundle of sheets.

When a coating roller is used, adhesive is coated by the shuttle movement of the coating roller along the spine of the bundle of sheets. It has been revealed, however, that uniform coating cannot be ensured if one coating is provided in the forward or backward motion.

Such irregular coating causes insufficient adhesion in some portion, hence insufficient strength of the booklet, whereas an excessive amount of adhesive is found in other portions. This has been found out to reduce the quality of the booklet.

In many cases, booklets are formed by wrapping a bundle of sheets with a cover sheet.

FIG. 1 shows a booklet wherein the amount of adhesive is excessive. As shown in FIG. 1, a lump of uneven adhesive is formed on the boundary line between the sheet bundle SS and cover sheet S2, and the quality of the booklet is deteriorated by this lump. Further, projections and depressions are produced on the spine area of the cover sheet S2 to reduce the quality of the booklet.

SUMMARY OF THE INVENTION

One aspect of the present invention is as follows.

1. A bookbinding apparatus provided with a coating device including a coating roller wherein, when this coating roller is located face to face with the sheet bundle, relative movement of the aforementioned coating roller and bundle of sheets is caused to coat adhesive on the spine of the sheet bundle; wherein coating is performed in the forward and backward movement in the step of relative movement of the aforementioned coating roller and the aforementioned sheet bundle; a first regulating member for regulating the thickness of the layer of the adhesive coated on the spine of the sheet bundle is provided downstream of the coating roller in the forward movement; and a second regulating member for regulating a thickness of a layer of the adhesive coated on the spine of the sheet bundle is provided downstream of the coating roller in the backward movement.

2. An image forming system including: an image forming apparatus for forming an image on a sheet of paper, and the aforementioned bookbinding apparatus for binding a booklet by receiving sheets of paper ejected from this image forming apparatus.

DETAILED DESCRIPTION OF THE PREFERRED EMBODIMENT

The following describes the present invention with reference to illustrated embodiment. The present invention is not limited to the illustrated embodiment.

Figure 1:
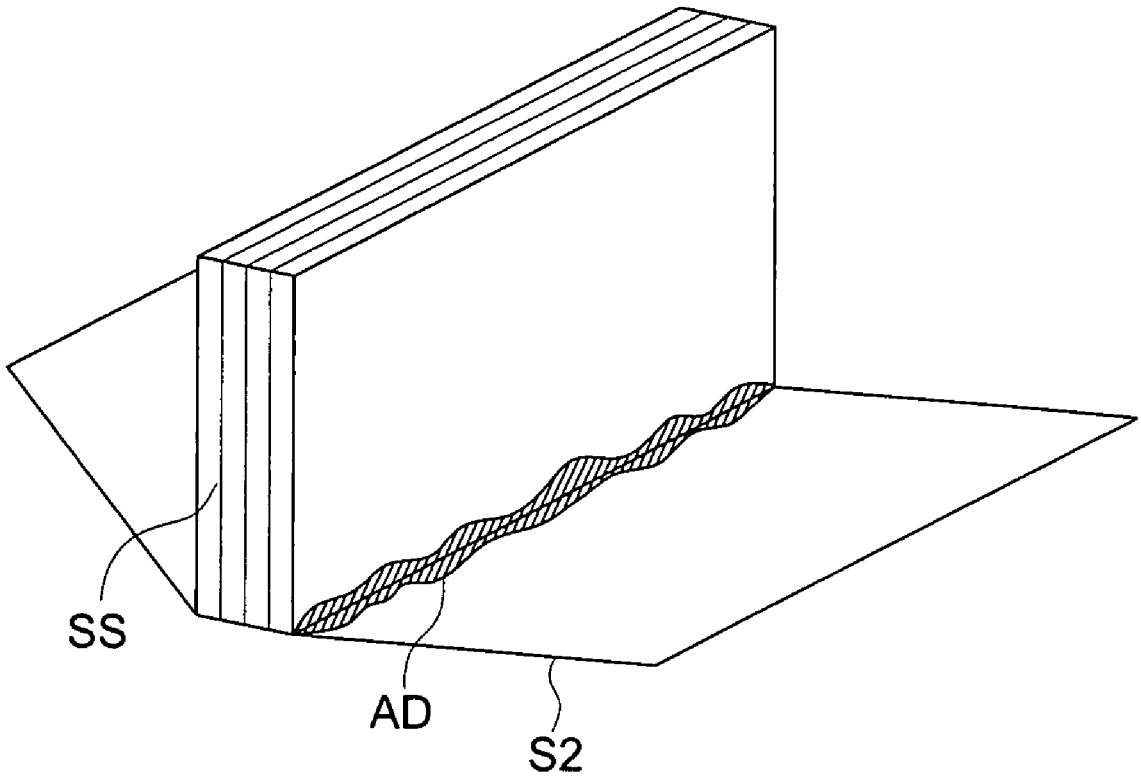
FIG. 1 is a drawing representing the booklet when the amount of adhesive is excessive.
Figure 2:
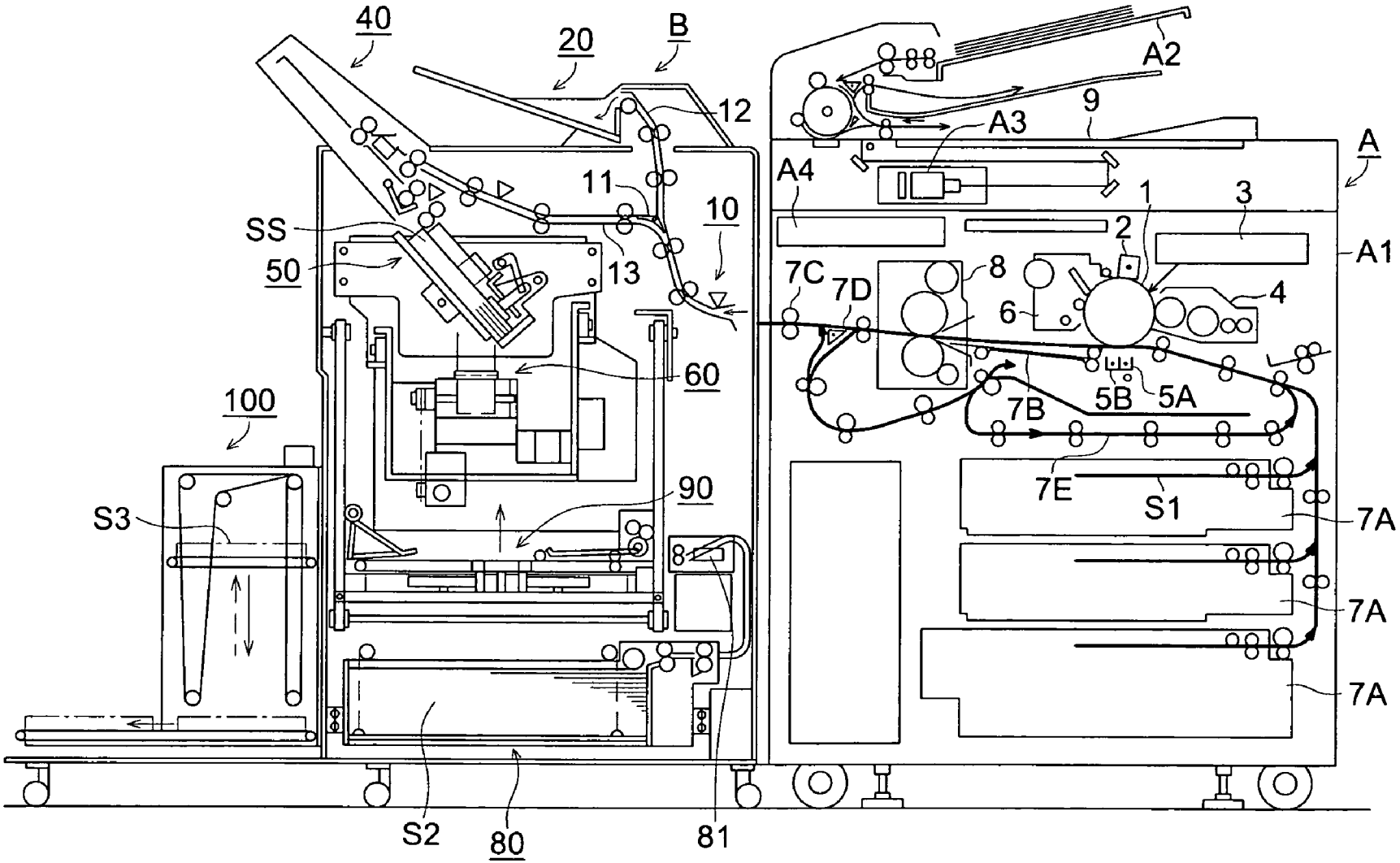
FIG. 2 is a drawing representing the overall view of the image forming system as an embodiment of the present invention.

FIG. 2 is a drawing representing the overall view of the image forming system as an embodiment of the present invention.

The image forming system has an image forming apparatus A and bookbinding apparatus B.

The image forming apparatus A forms an image on the sheet by the electrophotographic method, and includes an image forming section A1, document conveyance device A2, image reading section A3 and communication section A4.

In the image forming section A1, a charging device 2, exposure device 3, development device 4, transfer device 5A, separation device 5B and cleaning device 6 are located around the drum-like photoreceptor 1. Charging, exposure, development and transfer are carried out by these electrophotographic process devices, and a toner image is formed on the photoreceptor 1 so that an image is formed on the sheet S1.

The sheet S1 is accommodated in three sheet feed trays 7A, and sheets S1 are fed from these sheet feed tray 7A one by one. Then the toner image on the photoreceptor 1 is transferred onto the sheet S1 by the transfer device 5A.

The toner image transferred onto the sheet S1 passes through the fixing device 8, and the sheet is subjected to a process of fixing. The sheet S1 having been subjected to the process of fixing is ejected from the ejection roller 7C or is fed to the sheet re-feed path 7E.

In the face-down sheet ejection mode during the single-sided printing, face-up sheet ejection during single-sided printing mode or front image formation mode during two-sided image formation, a switching gate 7D switches the sheets S1 and guides them. To be more specific, in the face-up sheet ejection mode, the switching gate 7D allows the sheets S1 to travel straight. In the face-down sheet ejection and two-sided image formation mode, the switching gate 7D guides the sheets S1 downward.

In the face-down sheet ejection mode, the sheets S1 are fed forward and are then switched back to travel upward to be ejected from the ejection roller 7C.

In the two-sided image formation mode, the sheets S1 are fed downward and are then reversed by switch-back. After passing through the sheet re-feed path 7E, the sheets are re-fed to the transfer section wherein a transfer device 5A is located, and are subjected to transfer of the image on the back side.

The document conveyance device A2 feeds the documents one by one to the reading position. The image reading section A3 reads the image on the document conveyed by the document conveyance device A2 or the document mounted on a document platen 9, whereby an image signal is generated. The communication section A4 communicates with the network equipment, and generates an image signal in response to the image forming command sent via the network.

The bookbinding apparatus B bundles a plurality of the sheets fed from the image forming apparatus A, and forms a sheet bundle. It then connects the sheet bundle with a sheet for a cover and forms a book. In the following description, the sheet of the present embodiment is referred to as a sheet S1, and the sheet for the cover is called a cover sheet S2. The sheets of the present embodiment connected with the cover sheet will be referred to as a booklet S3.

The bookbinding apparatus B includes: a conveyance section 10 for conveying the sheet S1 ejected from the image forming apparatus A, to an ejection tray 20 or a sheet reversing section 40; an ejection tray 20; a sheet reversing section 40; a stacking section 50 for stacking the sheets S1 having been conveyed one by one or in units of several sheets; a coating device 60; a cover sheet storage section 80 for storing the cover sheets S2; a cover sheet support section 90 for supporting the cover sheets; and an ejection section 100.

The sheet S1 ejected from the image forming apparatus A is ejected to the ejection tray 20 through an ejection path 12 by the switching gate 11 provided on the conveyance section 10, or is conveyed to the sheet reversing section 40. If the mode is not a bookbinding mode, the sheet S1 is ejected to the ejection tray 20.

In the bookbinding mode, the sheet S1 is conveyed to the sheet reversing section 40 through the conveyance path 13, and is switched back by the sheet reversing section 40. After that, the sheet S1 is conveyed to the stacking section 50. A predetermined number of sheets S1 are stacked on the stacking section 50. When filled with a predetermined number of sheets S1 stacked therein, the stacking section 50 rotates to hold the bundle of the sheets S1 almost in the perpendicular position.

The coating device 60 coats adhesive onto the underside of the bundle of the sheets S1 held in the perpendicular position by the stacking section 50.

The cover sheet S2 comes in contact with the bundle of sheets S1 coated with adhesive, and are bonded together.

The booklet S3 having been formed by bonding of the cover sheet S2 to the bundle of sheets S1 is ejected to the ejection section 100.

Figure 3:
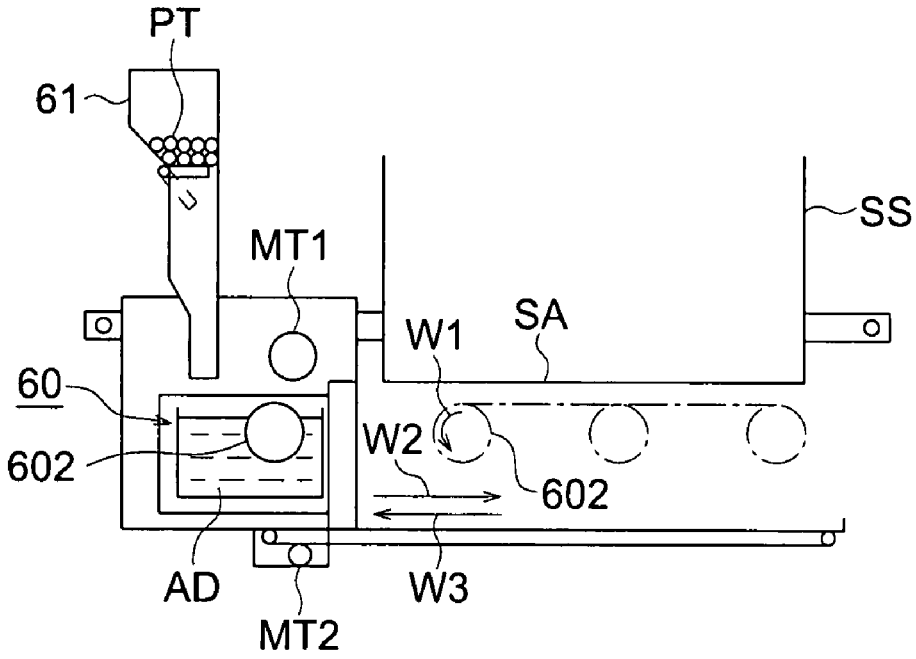
FIG. 3 is a drawing representing the coating process.

FIG. 3 is a drawing representing a coating process.

The coating device 60 is arranged below the sheet bundle SS of the sheet S1. During the forward movement driven by a motor MT1 and indicated by an arrow mark W2, the coating roller 602 applies adhesive AD to the spine SA of the sheet bundle SS. During the backward movement indicated by an arrow mark W3, the coating roller 602 applies adhesive AD to the spine SA.

The home position of the coating device 60 corresponds to the left end position of FIG. 3. It is located on the furthest side as viewed from the front side of the bookbinding apparatus B. At the home position, adhesive pellets PT are replenished from a supply device 61. The coating roller 602 is driven by a motor MT2, and is rotated in the direction denoted by the arrow mark W1 during the forward and backward movements so that adhesive is drawn up from an adhesive container 601, and the adhesive is applied to the spine SA of the sheet bundle. To be more specific, the coating roller 602 is rotated in the regular direction with reference to the spine SA during the forward movement of the coating roller 602, and in the reverse direction on the contrary during the backward movement.

Figure 4:
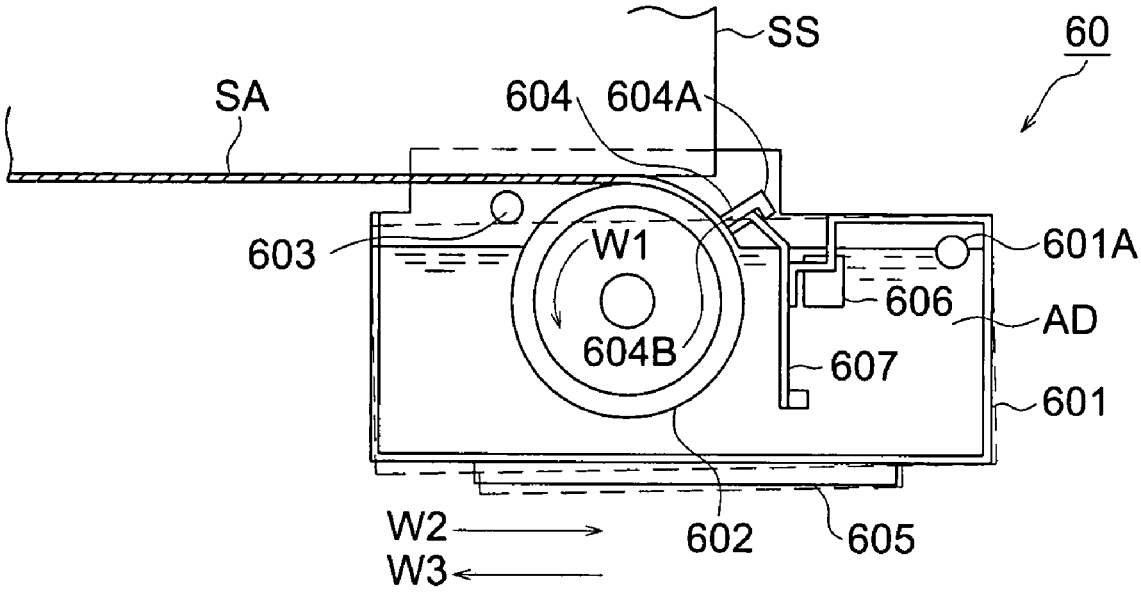
FIG. 4 is a drawing representing the configuration of the coating device 60.

FIG. 4 is drawing representing the structure of a coating device 60.

The coating device 60 includes an adhesive container 601 for accommodating an adhesive AD, a coating roller 602, regulating members 603 and 604, heater 605 and adhesive amount sensor 606.

The pellets in the adhesive container 601 are heated and melted by a heater 605, whereby a coating solution of adhesive AD is prepared. The amount of the adhesive AD is sensed by an adhesive amount sensor 606 made up of a temperature sensor, and the liquid surface is kept at a predetermined level. The reference numeral 603 denotes a regulating member of an almost circular cross section as a rod-like the first regulating member (first regulating member), and a regulating member 604 as a second regulating member is supported by a plate-formed support member 607. The thickness of the adhesive layer on a coating roller 602 is regulated by the bottom end edge 604B thereof, and the thickness of the adhesive layer on the spine SA of the sheet bundle is regulated by the top end edge 604A.

The adhesive container 601 rotates about an axis 601A from the wait state indicated by a dotted line to the coating state indicated by a solid line, and is set in position.

Figure 5:
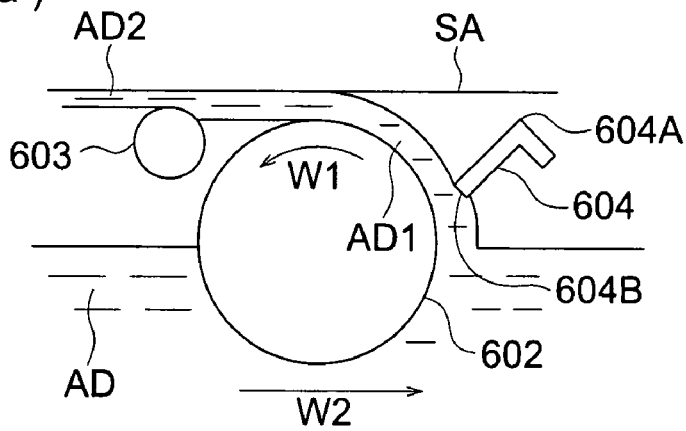
FIGS. 5(*a*) and 5(*b*) are a drawings illustrating the details of the process of coating the adhesive.
Figure 5:
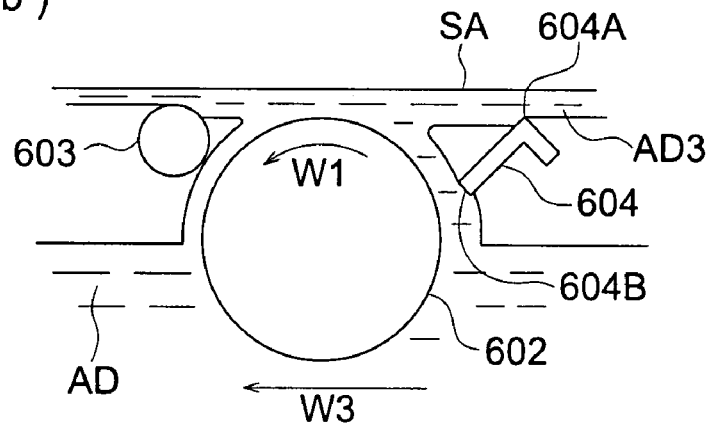

Referring to FIGS. 5(*a*) and 5(*b*), the following describes the details of the adhesive coating process.

FIG. 5(*a*) shows the coating process in the forward movement wherein the coating device 60 moves in the direction indicated by W2.

During the forward movement, the coating roller 602 rotates in the direction indicated by the arrow mark W1, and the coating device 60 moves in the direction indicated by the arrow mark W2, whereby adhesive AD is applied to the spine SA of the sheet bundle. The thickness of the adhesive layer AD1 on the coating roller 602 is adjusted to a uniform level by the bottom end edge 604B of the regulating member 604. Further, the adhesive layer formed on the spine SA of the sheet bundle by coating is regulated by the regulating member 603, whereby the thickness of the adhesive layer AD2 is made uniform. The regulating member 603 is made up of a circular rod having an almost circular cross section.

FIG. 5(*b*) shows a coating process in the backward movement mode wherein the coating device 60 moves in the direction W3.

In the backward movement mode, the coating roller 602 rotates in the direction W1 to provide coating, and the adhesive layer AD1 by the bottom end edge 604B is regulated. The surface of the adhesive layer AD3 formed in the backward movement mode is regulated by the top end edge 604A of the regulating member 604. The top end edge 604A is formed as an edge-shaped top by bending a plate material.

The coating roller 602 rotates in one direction in both the forward and backward movement modes, namely, in the direction indicated by the arrow mark W1. Thus, in the forward movement indicated by the arrow mark W2, coating is performed by the coating roller 602 traveling in the regular direction of reducing the difference in speeds between the roller surface and the spine SA of the sheet bundle SS. In the backward movement indicated by the arrow mark W3, coating is provided the reverse direction of increasing the aforementioned difference in speeds.

This procedure allows a thicker layer to be formed in the forward movement mode, while in the backward movement mode, a thinner layer is formed in the forward movement mode on the layer formed in the forward movement mode. At the same time, the layer formed in the forward movement mode is made uniform.

Figure 6:
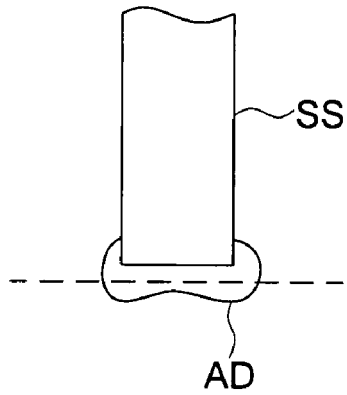
FIG. 6 is a drawing representing the regulation of an adhesive layer formed on the booklet.

When regulation by the regulating member 603 and by the top end edge 604A is not used, adhesive rises on the end of the sheet bundle SS along the thickness, as shown in FIG. 6, and excessive adhesive is coated. When the cover sheet is brought in contact, the adhesive comes off the edge, with the result that the quality of the booklet is reduced. A thinner portion of the adhesive layer is formed so that the sheet separation is facilitated. As a result, a booklet of insufficient strength is produced in some cases. However, if the regulation function of the regulating members 603 and 604 is utilized twice, the adhesive AD is regulated as indicated by the dotted line of FIG. 6, and uniform adhesion is ensured between the sheets of the bundle, and between the sheet bundle and cover sheet. At the same time, the adhesive is protected against coming off the edge.

It is preferred that the space between the spine SA of the sheet bundle and the regulating surface (peaked surface of the regulating member 603) of the regulating member 603 in the forward movement should be slightly smaller than the space between the spine SA and the regulating surface (space formed with the top end edge 604A) of the regulating member 604 in the backward movement.

To put it more specifically, the space between the spine SA and the coated surfaced of the coating roller 602 is 1.0 mm, the space between the spine SA and the regulating surface of the regulating member 603 is 1.0 mm, and the space between the spine SA and the regulating surface of the regulating member 604 is 1.5 mm. This arrangement has resulted in formation of a uniform coated layer.

As described above, a greater space is provided in the regulating surface of the regulating member 604. This arrangement is preferred for the following reason.

The regulating member 603 is a rod-like member of circular cross section having a greater curvature than that of the regulating member 604. For this structure, the adhesive solution deposited on the peripheral surface of the regulating member 603 tends to fall and separate from the regulating member 603. However, the regulating member 604 is a plate-formed member, although it depends on the installation angle. This makes it more difficult for the adhesive on the regulating member 604 to move.

If the adhesive deposited on the regulating member does not move, smooth removal of the adhesive moving successively to the regulating member under regulation cannot be achieved. Thus, the adhesive will return to the spine SA, and will be deposited on the side of the sheet bundle SS. This leads to formation of an uneven adhesive layer.

Thus, the regulating member 603 is located closer to the spine SA so that the regulating function is improved, while the space between the regulating member 604 and spine SA is made greater than that between the regulating member 603 and spine SA. This arrangement ensures formation of a uniform coated layer.

Further, the regulating member is preferably made of a material having a higher thermal conductivity so that the deposited adhesive is easily melted by heat. Copper is preferably used for this purpose.

In the present invention, adhesive is coated in the forward and backward movement modes in the relative movement of a coating roller and sheet bundle, and the thickness of a coated layer is regulated by a regulating member in each of the forward and backward movements, whereby local excess or deficiency in the amount of adhesive is avoided. This arrangement of the present invention provides a bookbinding apparatus and image forming system capable of producing a booklet characterized by excellent adhesive strength and high quality.

What is claimed is:

1. A bookbinding apparatus including a coating device having a coating roller to coat an adhesive onto a spine of a sheet bundle by moving relatively the coating roller and the spine in both forward and backward movement while making the coating roller and the sheet bundle to face each other, the coating device comprising:

(a) a first regulating member provided downstream of the coating roller in the forward movement, which regulates a thickness of a layer of the adhesive coated on the spine of the sheet bundle by coming into direct contact with the layer of the adhesive after the adhesive is coated on the spine during the forward movement; and (b) a second regulating member provided downstream of the coating roller in the backward movement, which regulates a thickness of a layer of the adhesive regulated by the first regulating member by coming into direct contact with the layer of the adhesive after the adhesive is coated on the spine during the backward movement.

2. The bookbinding apparatus of claim 1, wherein the first regulating member is formed by a circular rod having a substantially circular cross section.

3. The bookbinding apparatus of claim 1, wherein the second regulating member is formed by a plate material having an edge-shaped top, the edge-shaped top being closer to the sheet bundle than other portions of the second regulating member.

4. The bookbinding apparatus of claim 3, wherein the second regulating member regulates a thickness of an adhesive layer on the coating roller at an edge portion other than the edge-shaped top of the second regulating member.

5. The bookbinding apparatus of claim 1, wherein the coating roller rotates in one direction both in the forward and backward movement so that the coating roller rotates in a regular direction during the forward movement thereof in which a relative velocity between a surface of the coating roller and the spine of the sheet bundle is reduced.

6. The bookbinding apparatus of claim 1, wherein the first regulating member is made of a circular rod having a substantially circular cross section, the second regulating member is formed by a plate material, and a distance between the spine of the sheet bundle and an uppermost regulating point of the second regulating member is larger than a distance between the spine and an uppermost regulating point of the first regulating member.

7. An image forming system comprising:

(a) an image forming apparatus which forms an image on a sheet; and (b) the bookbinding apparatus of claim 1, which receives sheets ejected from the image forming apparatus and binds the sheets.

8. The bookbinding apparatus of claim 1, wherein during backward movement of the coating device, the coating roller coats the adhesive before regulating by the second regulating member.

* * * * *